US005585695A

United States Patent [19]

Kitai

[11] Patent Number: 5,585,695

[45] Date of Patent: Dec. 17, 1996

[54] THIN FILM ELECTROLUMINESCENT DISPLAY MODULE

[75] Inventor: Adrian H. Kitai, Hamilton, Canada

[73] Assignee: Adrian Kitai, Hamilton, Canada

[21] Appl. No.: 464,006

[22] Filed: Jun. 2, 1995

[51] Int. Cl.[6] ..... H05B 33/22

[52] U.S. Cl. ..... 313/506; 313/509; 313/512

[58] Field of Search ..... 313/506, 505, 313/509, 512; 428/917

[56] References Cited

U.S. PATENT DOCUMENTS

| | | | |
|---|---|---|---|
| 3,479,646 | 11/1969 | Requa . | |
| 3,701,123 | 10/1972 | Barrett et al. | 340/173 LS |
| 3,976,906 | 8/1976 | Shattuck | 313/500 |
| 4,006,383 | 2/1977 | Luo et al. | 315/169 |
| 4,266,223 | 5/1981 | Frame | 340/719 |
| 4,737,684 | 4/1988 | Seto et al. | 313/506 |
| 4,739,320 | 4/1988 | Dolinar et al. | 340/781 |
| 4,801,844 | 1/1989 | Barrow et al. | 313/509 |
| 4,802,873 | 2/1989 | Barrow et al. | 445/6 |
| 4,894,116 | 1/1990 | Barrow et al. | 156/643 |
| 4,983,880 | 1/1991 | Abdalla et al. | 313/506 |
| 4,999,539 | 3/1991 | Coovert et al. | 313/505 |
| 5,003,222 | 3/1991 | Washo | 313/511 |
| 5,017,824 | 5/1991 | Phillips et al. | 313/13 |
| 5,043,631 | 8/1991 | Kun et al. | 315/169.3 |
| 5,124,204 | 6/1992 | Yamashita et al. | 428/331 |
| 5,133,036 | 7/1992 | Tornqvist | 385/130 |
| 5,309,060 | 5/1994 | Sharpless et al. | 313/511 |
| 5,371,434 | 12/1994 | Rawlings | 313/506 |
| 5,377,031 | 12/1994 | Vu et al. | 359/59 |

*Primary Examiner*—Sandra L. O'Shea
*Assistant Examiner*—Vip Patel
*Attorney, Agent, or Firm*—Hill & Schumacher

[57] ABSTRACT

A thin film electroluminescent display module sealed against moisture with driver chip and optional lens is disclosed. The module is formed on a transparent substrate upon which a sequence of patterned thin layers is deposited and a patterned sealing layer and driver circuit(s) are applied. In one aspect the tile element achieves over 100 fL brightness in a 5×7 format with circular pixels. Expansion to a 16×16 format is also disclosed and a novel addressing geometry suitable for tiled displays is presented. The application of a unique insulator layer allows flexible interconnections with conductor crossovers to address pixel arrays in formats offer than X-Y matrix addressing. The absence of edge connections and a bulky edge seal permits production of a tiled display in which module-to-module spacing is not limited by connectors or seals. Multiple electroluminescent display modules may be tiled together edge-to-edge to form a large display panel.

18 Claims, 6 Drawing Sheets

THIN FILM ELECTROLUMINESCENT DISPLAY MODULE

FIELD OF THE INVENTION

This invention relates to thin film electroluminescent (EL) display modules which may be tiled together to form a larger EL display panel.

BACKGROUND OF THE INVENTION

It is desirable to have an economical means of producing electroluminescent (EL) display modules that can be tiled together. A tiled display requires individual display tiles or modules that may be placed in close proximity to give the appearance of a continuous display. Of the four major flat panel technologies: plasma, liquid crystal, vacuum fluorescence and EL, the latter has the advantage that connections may, in principle, be placed anywhere on the module. This is possible because the device consists of one glass sheet with a series of solid state coatings. Liquid crystal, vacuum fluorescent and plasma modules require both front and rear sealing (usually glass) that restricts the connection paths to the module edges. In addition, a seal is required to prevent gas or liquid leakage at the edges of the module. The combination of seals and electrical connections makes it extremely difficult to tile modules especially at higher pixel resolutions.

Currently, X-Y matrix addressing is employed for EL displays and connections are made at the edges of the glass such as disclosed in U.S. Pat. No. 4,999,539 issued to Coovert et al. The surface area occupied by these connectors uses space near the peripheral edges of the module thereby producing a large gap between the display area and the edge of the substrate. Another drawback of conventional EL display modules is that many employ moisture barriers covering the entire back of the module for preventing moisture or other undesired ambient elements from entering the layered EL structure which are sealed around the perimeter of the glass substrate. These moisture barriers also result in a gap between the display area and the edge of the substrate. Thus, areas around the edge of the module used for connections and sealing do not allow for radiating display elements to exist in these areas. This causes the module dimensions to exceed the active area of the module which adds to module size, weight and cost.

U.S. Pat. No. 5,124,204 issued to Yamashita et al. briefly reviews a typical prior art EL panel comprising the display elements formed on a glass substrate. This prior art EL panel is sealed by a glass cover sheet bonded to the glass substrate with silicone oil, containing silica gel powder, being sealed between the display element and the cover sheet. This arrangement is both heavy and results in a significant gap between the edge of the glass substrate and the outer edge of the display element. Yamashita et al. reduces the weight problem by replacing the glass cover sheet with a polymer based moisture-proof sheet; however, the drawback of the edge gaps remains thereby precluding tiling together of multiple modules.

U.S. Pat. No. 4,266,223 issued to Frame discloses a display device comprising thin film transistor circuits for sequentially switching a brightness control signal to an array of individual display elements. The device comprises transversely-spaced or interdigitated metallic electrode finger arrays deposited onto a glass substrate and an electroluminescent layer deposited on top thereof which is then coated with an insulator and then contact electrodes. Transistor arrays are then deposited on top of these display elements. Transversely-spaced electrodes and thin film transistor circuits are difficult and expensive to manufacture.

It would therefore be advantageous to provide an electroluminescent display module comprising an EL layer structure which avoids the need for edge connections and edge sealing so that the active area of each module extends to the edge of that module such that no extra gap is visible between active areas of adjacent modules tiled together. It would also be advantageous in such a structure to use a transparent substrate with an EL structure that allows connections to the rear of the substrate whereby the light reaches the viewer through the transparent substrate from the front.

SUMMARY OF THE INVENTION

It is an object of the present invention to provide an EL module comprising a multitude of radiating display elements which may be electrically controlled with driver circuitry mounted directly on the rear of the module thereby reducing the number of external connections necessary to operate the module.

It is another object of the present invention to provide an EL module which significantly reduces the gap between the light emitting display elements and the edge of the substrate thereby facilitating tiling of multiple EL modules.

The present invention features an outer light permeable or transparent substrate (e.g., plastic or glass) upon which is added a series of conducting, insulating and radiating thin films which comprise a third film EL structure. The layers comprising the EL structure are patterned to create openings and/or separated regions in various layers, such as to define a number of display elements and connection pads for electrical activation of the EL display elements.

The present invention also provides a means of sealing the moisture sensitive thin film layer or layers from ambient conditions. The present invention also provides an EL electronic driver chip that is mounted above the EL display elements on the back side of the substrate and connected with the EL connection pads. The EL driver chip is able to control the intensity of the radiation emitted from the display elements.

In one aspect of the present invention there is provided an electroluminescent display module comprising a light permeable substrate having a front, a back and side edges. The module includes an array of display elements comprising a light permeable electrically conductive base coated on said substrate, CL plurality of electroluminescent areas, and a counterelectrode coating at least part of each electroluminescent area. One of either the light permeable electrically conductive base or the counterelectrode is patterned to provide a plurality of electrically isolated sections each with an associated exposed contact pad, and the other of the conductive base and counterelectrode is a common electrode to at least some of the electroluminescent areas. Each electroluminescent area is sandwiched between an electrically isolated section and the common electrode. The contact pads are spaced inwardly from the substrate edges so that electrical contact to the array of display elements is made to the display module spaced away from the edges of the substrate.

A plurality of the EL display modules can be tiled together in edge-to-edge relationship to form an electroluminescent display panel.

In another aspect of the invention there is provided an electroluminescent display module comprising a plurality of light permeable substrates having a front, back and side edges. The plurality of light permeable substrates are tiled together in edge-to-edge relationship to form an expandable display panel. The module includes an array of display elements spaced on the back side of the light permeable substrate each comprising a light permeable electrically conductive base portion coated on the light permeable substrate, a counterelectrode and an electroluminescent material sandwiched between the conductive base portion and a portion of the counterelectrode. The module includes a display driver chip with a plurality of contact pins mounted on the substrate. The display driver chip is mounted on the back side of the light permeable substrate with each pin being electrically connected to a preselected number of display elements at positions spaced inwardly from the substrate edges. Control signal means is attached to the counterelectrode.

BRIEF DESCRIPTION OF THE DRAWINGS

The electroluminescent (EL) module constructed in accordance with the present invention will now be described, by way of example only, reference being had to the accompanying drawings, in which.

DETAILED DESCRIPTION OF THE INVENTION

Figures 1, 6:
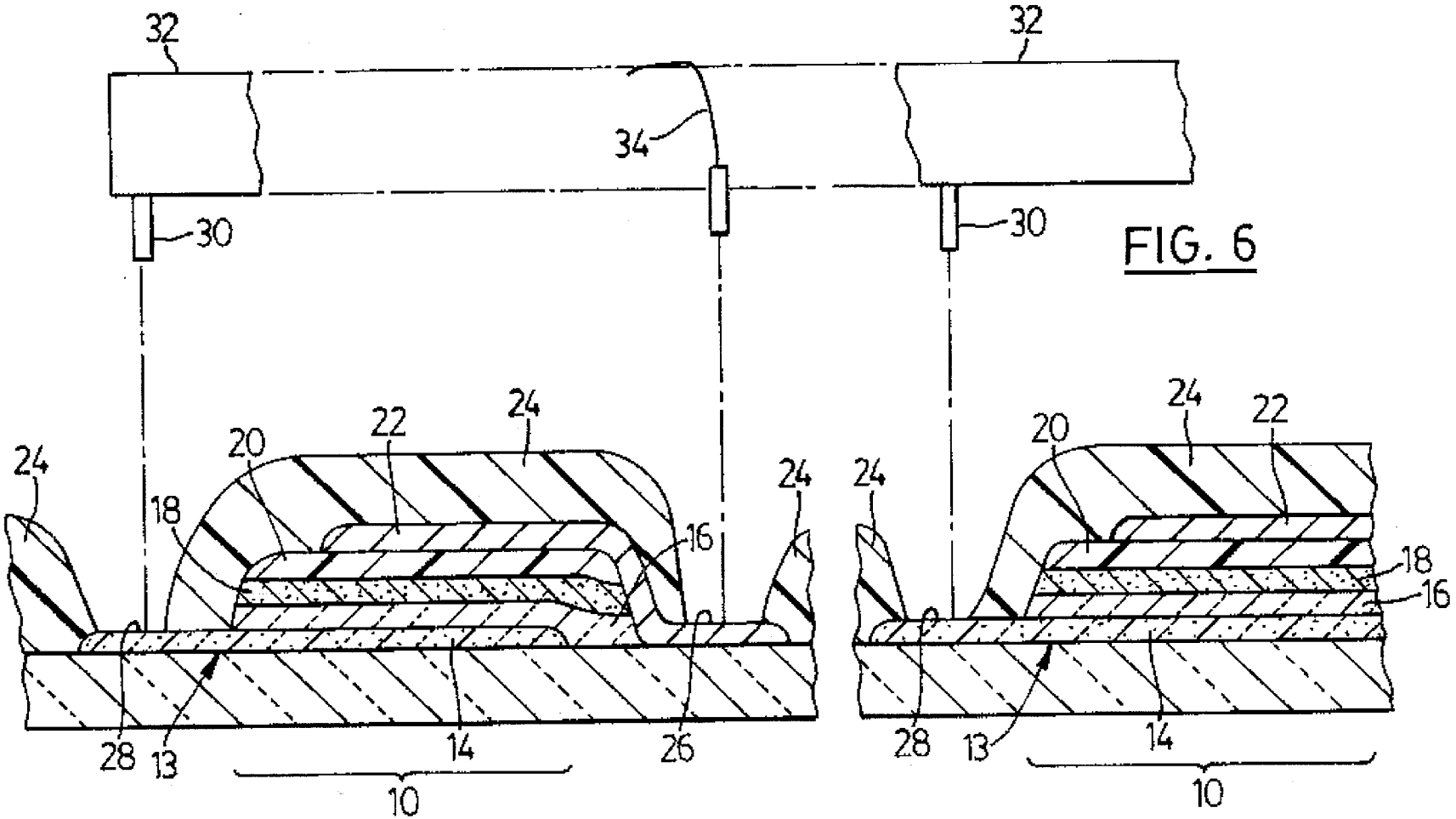
FIG. 1 is a cross sectional view, broken away, of a layered EL display structure of an EL module constructed in accordance with the present invention.
FIG. 6 shows part of a signal control circuit and driver chip with protruding connectors to be electrically connected to the EL display of FIG. 1.

In the ensuing description of the structure and operation of the EL display devices constructed in accordance with the present invention, like numerals in the drawings of different embodiments refer to the same materials. Referring first to FIG. 1, a cross section of essentially one and a half display elements or pixels of an electroluminescent (EL) module constructed in accordance with the present invention is shown. A display element 10 is formed on a standard 1.1 mm thick light permeable substrate 12 upon which a transparent or generally light permeable and electrically conductive thin (500–3000 Å) coating 13 is deposited. Substrate 12 may be glass or plastic but other suitable substrates may also be used depending on the application. A preferred conductive coating is one of several conducting metal oxides, preferably indium-tin-oxide (ITO), tin oxide, indium oxide or aluminum doped zinc oxide (ZnO:Al). The conducting oxide may be deposited by any of a number of physical or chemical deposition processes such as atomic sputtering, ion beam deposition and thermal evaporation to mention just a few.

Figure 2:
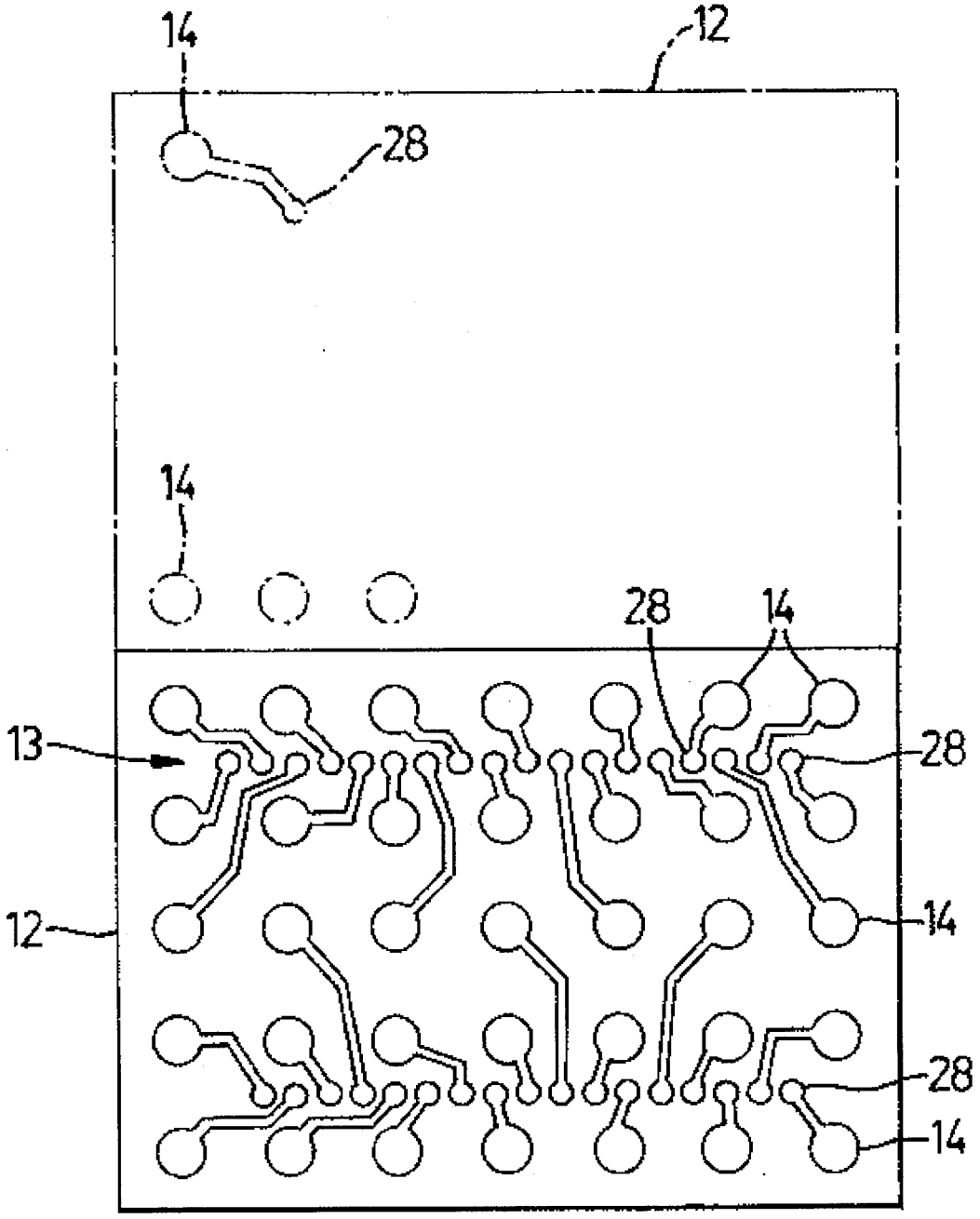
FIG. 2 shows a pattern for the conductive ITO electrode layer deposited onto a glass substrate for a 35 element EL display module shown in cross section in FIG. 1.
Figure 3:
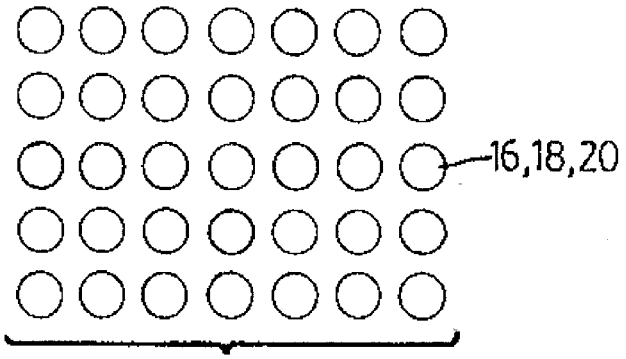
FIG. 3 is a top view of the pattern formed by the electroluminescent layer sandwiched by two insulator layers in the display element of FIG. 1.
Figure 4:
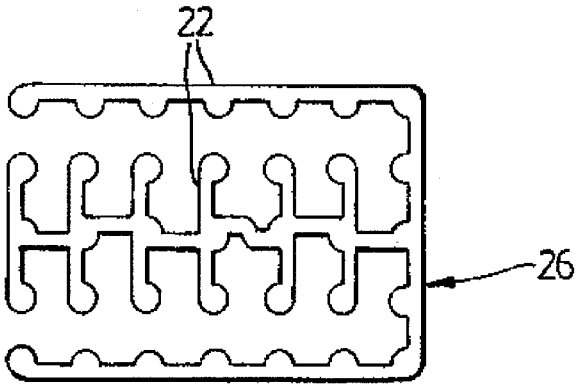
FIG. 4 is a top view of the pattern formed by a conducting metal layer deposited onto the sandwich structure shown in FIG. 3.
Figure 5:
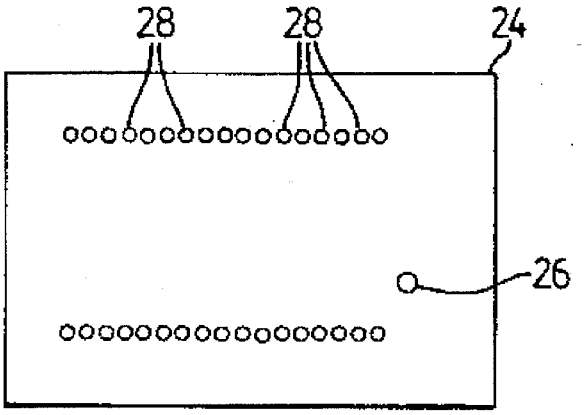
FIG. 5 is a top view of the pattern formed by a sealing layer deposited onto the metal layer and sandwich array of FIGS. 3 and 4.

An example of a final pattern of the deposited ITO layer 13 is shown in FIG. 2 and comprises an array of 35 (5×7) circular ITO electrodes 14 each interconnected to an associated connector pad 28 which is exposed in the assembled module. This pattern may be obtained by using suitable masks during deposition of the ITO, or alternatively, the ITO may be deposited as a continuous layer and then etched afterward to provide the pattern of FIG. 2 using known masking/etching procedures. After deposition of the patterned conducting oxide layer 13 a transparent thin (1000–5000 Å) insulator layer 16 is then deposited on top of the conducting oxide and patterned using similar masking or etching techniques used to deposit the conductive oxide layer 13. Insulator layer 16 is a thin film dielectric insulating material such as silicon oxy-nitride, silicon-aluminum oxy-nitride, tantalum oxide, aluminum oxide, yttrium oxide or other known thin film dielectric material having high breakdown strength. FIGS. 3 to 5 show the mask patterns used in conjunction with the ITO patterned layer 13 of FIG. 2 and will be more fully discussed below.

A thin (4,000–10,000 Å) electroluminescent layer 18 (which functions essentially as a phosphor layer) is then deposited onto the patterned conductive oxide layer portion 14 coated by insulator layer 16 leaving portion 28 exposed. A preferred electroluminescent material is such as ZnS:Mn but other materials which could be used include SrS:Ce, $Zn_2SiO_4$:Mn or ZnS:TbF. EL layer 18 is patterned either by masking during growth or by etching after growth similar to the other two layers. Another transparent thin dielectric or insulator layer 20 is deposited to cover EL layer 18 and may be the same material comprising layer 16 with a comparable thickness.

An electrically conductive thin film (~2000 Å) counterelectrode layer 22 of for example aluminum is deposited and patterned either by masking during growth or by etching after growth. A sealing layer 24 is then deposited and in a preferred embodiment layer 24 is silicon nitride $Si_3N_4$ applied by sputtering. The $Si_3N_4$ layer is patterned by either masking during deposition or etching thereafter to produce the patterned layer 18 of FIG. 1 wherein the aluminum metal film 22 is exposed at 26 to provide an electrical contact pad to aluminum layer 22 common to all pixels while patterned conducting oxide layer 13 is exposed at 28 to provide an electrical contact pad to each pixel 10. Thus, the ITO electrode base 13 comprises a first portion 14 which underlies each display element 10 and a second exposed portion 28 to which electrical contact is made to form the control circuit to drive the display elements.

FIG. 3 is a top view of the pattern formed by the generally superimposed layers 16, 18 and the top insulating layer 20 deposited on the larger ITO contacts 14 of FIG. 2 to form the display elements or pixels 10. Each display element 10 is provided with an associated smaller ITO contact pad 28 shown in FIGS. 1 and 2. FIG. 4 shows the top view of the pattern formed in conductive layer 22 showing contact pad 26. Metal layer 22 at least partially covers the sandwich structure (14/16/18/20) in FIG. 1 and each contact pad 26 is connected with a drive signal to be described below. FIG. 5 shows the top view of the pattern formed by the silicon nitride ($Si_3N_4$) sealing layer 24. The 35 electrical pads 28 in FIG. 2 are shown exposed through sealing layer 24 which are contacted by contacts 30 projecting from driver chips 32 which are mounted directly above the sealing layer 24 (FIG. 6) which will now be discussed.

Referring specifically to FIG. 6, a typical EL driver chip 32 is a silicon integrated circuit, for example Supertax Inc, HV577, which is sealed in a plastic package and mounted on a printed circuit board (PCB) with 35 contacts 30 projecting therefrom each to contact a contact pad 28. Adhesion and good electrical contact between contacts 30 and contact pads 28 may be achieved using, for example, conductive pastes, conductive epoxy or solder. If solder is used then contact pads 28 are preferably coated with a suitable metal such as copper or silver before the solder is applied. Contact pad 26 is connected to a wire 34 using conductive paste or conductive epoxy. Wire 34 is connected to an AC drive signal of 150 V. By supplying suitable voltage control signals to ITO pads 14 through driver chips 32 connected to ITO pads 28, control of the associated display elements or pixels is achieved.

When aluminum metal layer 22 is connected to a dive signal by a wire 34 connected to contact pad 26, it is driven by an AC drive signal that is set to a voltage of 150 V peak or below the turn-on voltage of the EL display elements. When an additional AC voltage is applied to a particular EL display pixel via contact pad 28 by means of driver chip 32 such that it's voltage of 50 V adds to the voltage on metal layer 22 then the corresponding EL pixel turns on sustaining a voltage of 200 V peak AC and light is emitted from that particular pixel. If the conductive portion 14 of the ITO base forming part of each pixel 10 is driven such that the applied voltage subtracts from the voltage applied to metal layer 22, then it turns off. In this way the array of display elements may be controlled individually.

Other methods of sealing the display modules instead of depositing a thin insulating layer may be utilized. Specifically, a thin glass plate or plastic cover sheet may be used with apertures etched or drilled through the plate or sheet to form the pattern shown in FIG. 5. This protective cover is bonded to the back of the layered EL structure using epoxy cement.

Figure 7:
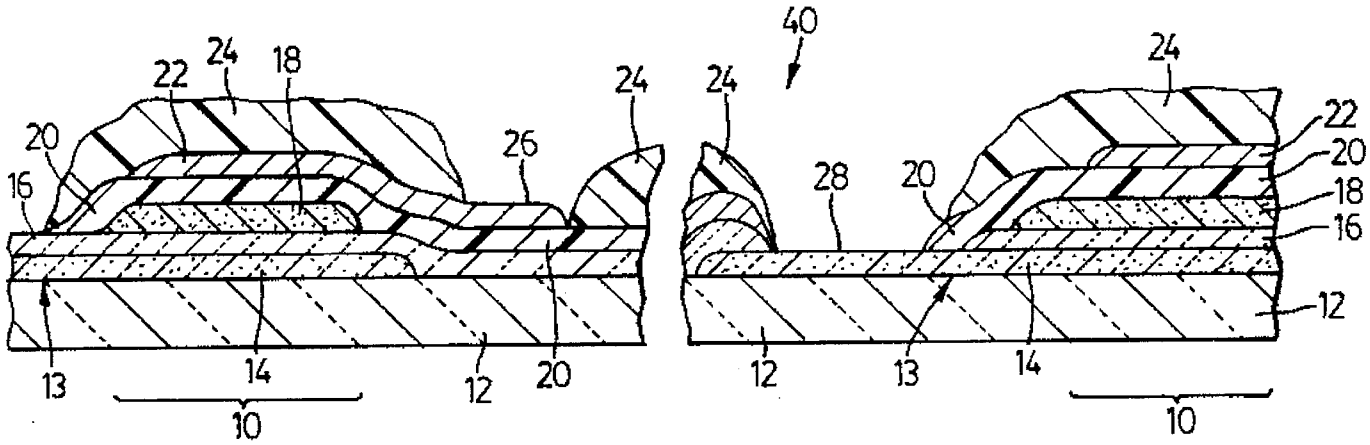
FIG. 7 is a cross sectional view of an alternative embodiment of a display element similar to FIG. 1 showing the EL layer sandwiched completely by two insulating layers.

FIG. 7 illustrates a portion of an alternative embodiment of a 5×7 display module at 40 which is very similar to the EL display module of FIG. 1. The ITO pattern 13 is the same as shown in FIG. 2 but in the cross section in FIG. 7 the EL layer 18 is sealed between the dielectric insulating layers 16 and 20 which both extend beyond the EL layer. The purpose of insulating layers 16 and 20 are to insulate EL layer 18 from ITO contacts 14 and metal layer 22 so that any configuration which accomplishes this would be suitable. Display modules such as illustrated in FIGS. 1 and 7 with the 5×7 array achieved over 100 fL brightness with circular pixels. Because ITO contact pads 28 and contact pad 26 are spaced inwardly from the edges of substrate 12, multiple display elements can be tiled together in edge-to-edge relationship. FIG. 2 shows two substrates 12 (one in ghost outline) tiled together wherein the gap between the display elements on the edges of adjacent substrates is the same as the gap between the display elements on the same substrate.

Referring to FIGS. 8 to 12, an alternative embodiment of an EL display module is shown. A conductive ITO pattern 44 is first deposited onto substrate 12, best seen in FIG. 9 comprising circular ITO pads 14 and rectangular contact pads 28. The pattern as shown is obtained either during deposition or by etching afterwards. Upon completion of pattern 44, a thin film insulating layer 52 is deposited, see FIG. 10. Insulating layer 52 is preferably silicon oxide ($SiO_2$) or polyimide and is deposited to a thickness in the range 0.5 to 3 μm. Insulator layer 16, EL layer 18, and insulator layer 20 are then sequentially deposited using appropriate masking during deposition or etching after deposition. Metal film 22 is then deposited with suitable masking to provide four separate metallized areas each having one contact pad 54 (best seen in FIG. 12) to provide a plurality of display elements 50. Display elements 50 lack the silicon nitride $Si_3N_4$ sealing layer 24 used in display elements shown in FIG. 1. In the embodiment shown in FIGS. 8 to 12, insulator layer 20 acts as a moisture barrier or seal in place of layer 24. The presence of insulating layer 52 allows metal layer 22 to pass directly above portions of conductive ITO film 14 which in this embodiment are common to four pixels and contact pads 54 may also be placed above layer 14. Thus, insulator layer 52 allows portions of ITO film 44 to pass below metal film 22 where desired. Each display element 50 is connected to the driver chips (not shown) and control signal source through the chip connections being made to ITO pads 28 and contact pads 54 on metal layer 22 on top of insulator layer 52 respectively. This geometry is advantageous if complex arrangements of light emitting elements and electrical contact pads are to be realized, since it allows layers 14 and 22 to pass under or over each other.

Figure 8:
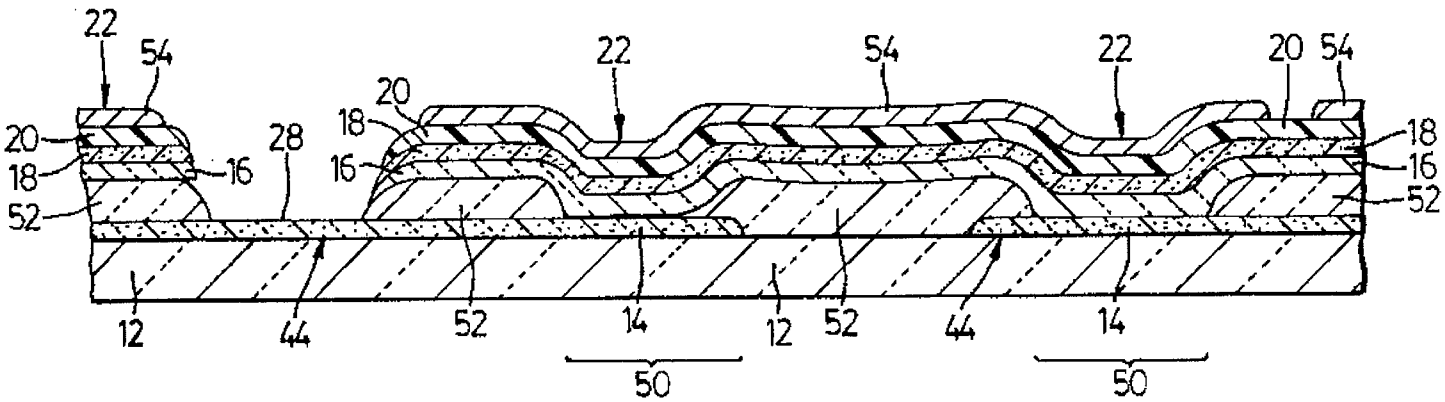
FIG. 8 is a cross sectional view, broken away, of an alternative embodiment of an EL module containing 256 display elements.
Figure 9:
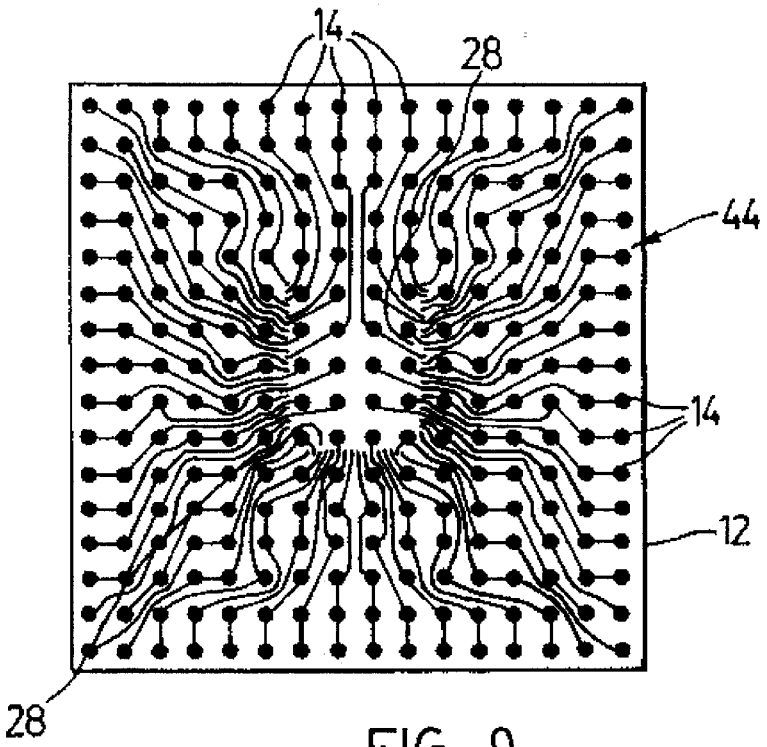
FIG. 9 is a top view of the pattern of a conducting ITO base of the EL module of FIG. 8.
Figure 10:
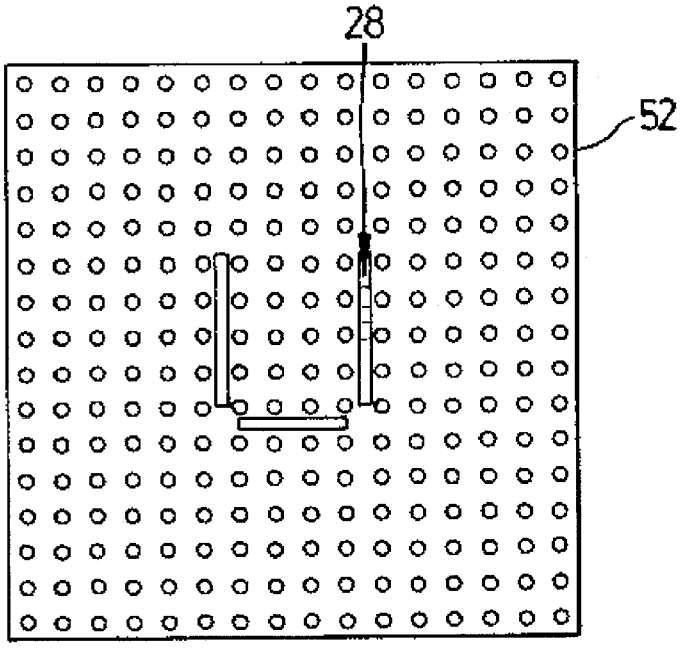
FIG. 10 is a top view of the pattern formed when a first insulating layer is deposited onto the ITO pattern of FIG. 9.
Figure 11:
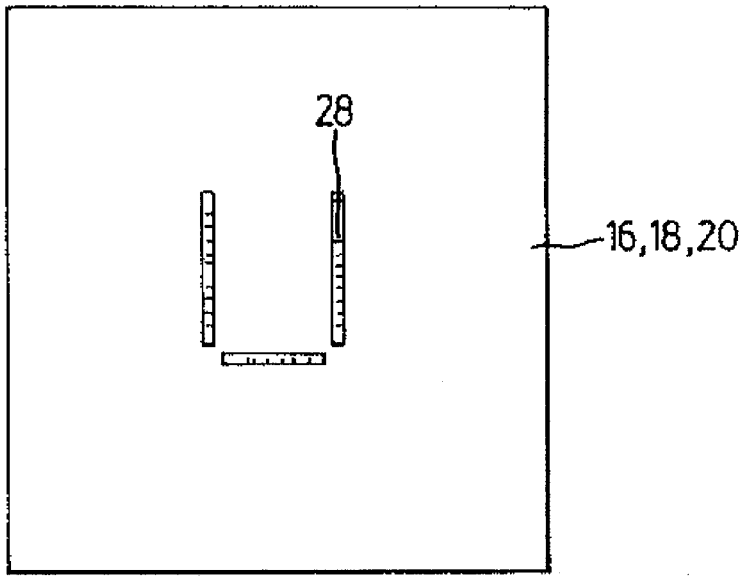
FIG. 11 is a top view of the pattern formed by the generally superimposed electroluminescence layer sandwiched by two insulator layers in the display element of FIG. 8.
Figure 12:
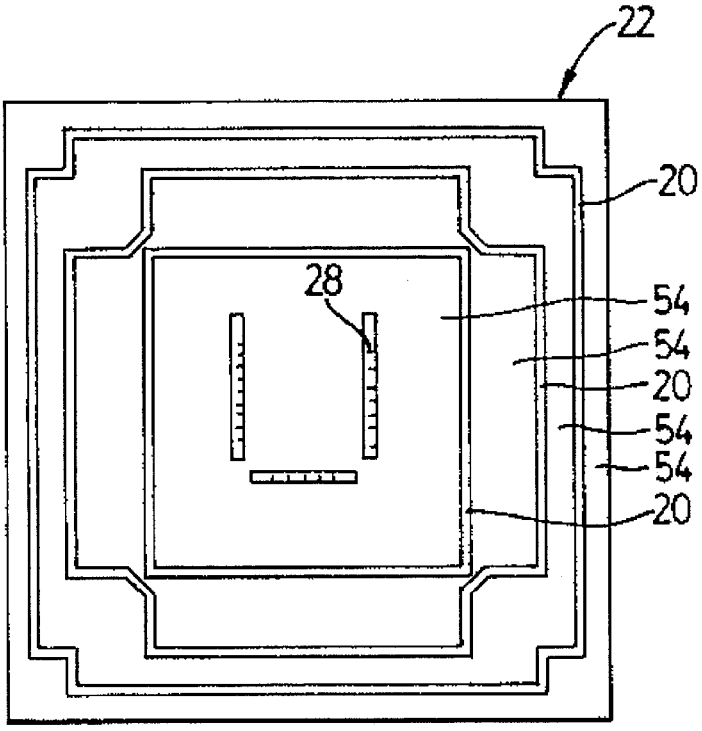
FIG. 12 is a top view of the pattern formed by the conducting metal layer deposited onto the sandwich structure shown in FIG. 11.

Referring again to FIG. 9, the top view of the pattern of the conducting ITO layer of the embodiment shown in FIG. 8 includes 256 circular ITO areas 14 wherein each ITO circle is connected to three other ITO circles. Electrical contact to each set of four connected ITO circles 14 is through the small rectangular ITO contact pad 28 (of which there are 64). Each ITO contact pad 28 is connected to one of 64 drivers contained in a driver chip (not shown). The top view in FIG. 10 shows the pattern formed by insulator layer 52 with the three white strips indicating the exposed contact pads 28. FIG. 11 is a top view of the pattern formed by the generally superimposed layers 16, 18 and 20 of FIG. 8. FIG. 12 shows the top view of the pattern formed by conductive film 22 deposited onto layer 20 wherein insulator layer 20 is exposed along the three generally rectangular perimeters. This results in four metallic regions insulated from each other formed in layer 22. Each region is connected to a wire at a metal contact pad 54. Each ITO contact pad 28 is connected to one of 64 drivers contained in a driver chip (not shown) which is adhered to the module by bonding each of 64 pin connectors to the 64 ITO contact pads 28.

Operation of the display module of FIGS. 8 to 12 utilizes multiplexing to address display elements 50. During multiplexing, an AC drive signal is applied via a first one of the four metallic contacts 54 to layer 22 of FIG. 12 connecting a driver (not shown) to the first region of metal layer 22. Simultaneously the 64 drivers connected to the display elements via the contact pads 28 in FIG. 9 supply AC signals that either add to, or subtract from, the voltage applied to the first region of metal layer 22 which turns on, or off, respectively, the corresponding 64 display elements that are covered by the first driven region of layer 22 of FIG. 12. After a short time, typically 100 μs, a second of the four contact pads 54 is driven in place of the first, and the 64 drivers connected to the display elements are driven so as to turn on or off the corresponding 64 display elements that are covered by this second metal region of metal layer 22. Subsequently, the third and then the fourth contact pad 54 in FIG. 12 is driven in appropriate synchronization with drivers driving the display elements via contact pads 28 so as to turn on or off the remainder of the 256 display elements. The entire aforementioned sequence then repeats itself at a rate of about 100 times per second to give the appearance of a static display in which each display element may be on or off.

Figure 13:
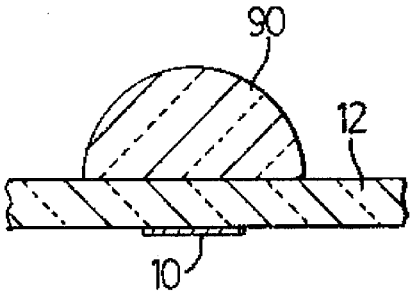
FIG. 13 is cross sectional view of another embodiment of the EL display device including a lens attached to the viewing side of the display substrate.

Referring to FIG. 13, plastic lenses 90 were bonded to the viewing side of substrate 12 to improve light collection from the pixels. Light that is normally internally reflected in the glass may be coupled out effectively using a plano-convex lens. Plexiglass was machined into lenses 90 that were bonded to the front of substrate 12 using optical cement. The use of lenses 90 increased the optical area of the pixels by up to 4 times without decreasing pixel brightness. This represents a four-fold improvement in optical coupling at a normal viewing angle, which is in line with estimated coupling efficiencies of 8–20% without lenses. The use of lenses also decreases or almost eliminates the apparent gaps between the display elements or pixels which makes the spacing of pixels in these modules useful for conductor paths which are not apparent to the viewer. However, the use of lenses decreases the viewing angle in that adjacent lenses block light from one another. A viewing angle of ±50° is typical with lenses.

It will be appreciated by those skilled in the art that other embodiments of the present EL module disclosed herein could be constructed with a larger number of display elements deposited onto the substrate and in addition the shapes of each element may be altered from circular to other more complex shapes. The positions of the display elements and the contact pads may be altered to arrange contact pads in a desired manner for convenient connection over the area of the display. If the electrode layers 14 and 22 were in the form of horizontal and vertical stripes respectively then a layout of a row and column display would be realized. In this embodiment, the contact pads formed on conductive layers 14 and 22 could be positioned in suitable locations between display elements and away from the edges of the EL module thereby avoiding a significant drawback of the prior art modules. The EL layer 18 may also be effectively sealed if dielectric layers 16 and 20 extend beyond the EL layer as shown in FIG. 7 where the dielectric layers essentially envelop EL layer 18. Thus, EL layer 18 may be broken into separate regions for each display element or pixel, while dielectric layers 16 and 20 are continuous between display elements.

It will be understood by those skilled in the art that instead of using a separate ITO base for each display element and associated ITO contact pad 28 with a common counterelectrode (FIGS. 1 to 7) the opposite arrangement could be utilized. A continuous ITO layer could be used along with separate counterelectrodes for each display element wherein the control chip would be connected to the separate counterelectrodes and the signal control means applied to the common ITO base. Similarly, instead of having a plurality of separate ITO bases electrically connecting a group of display elements with an associated ITO contact pad and a number of counterelectrodes equal to the number of display elements in the group (FIGS. 8 to 12), the opposite arrangement could be utilized.

The display modules using thin film EL technology constructed in accordance with the present invention are advantageous over the prior art EL devices because they permit pixel displays to be constructed wherein the electrical connection to the layers on the light permeable transparent substrate can be made away from the edges of each substrate thereby minimizing tile gaps. Driver chips may be mounted with or without PCB's directly onto the back side of substrate 12 above the EL pixels opposite to the side which is viewed. The array of electroluminescent display elements in the modules shown in FIGS. 1, 7 and 8 can extend across the full length of substrate 12 from edge-to-edge. A multiple number of the EL modules may then be tiled together in edge-to-edge relation to form a larger EL display panel. The Use of patterned circular pixels allows simple hemispherical lenses to be mounted directly onto the viewing side of the transparent substrate to enhance optical coupling, and insulator layer 52 advantageously permits electrode crossovers in more complex layouts.

The EL modules constructed according to the present invention matched brightness levels of commercially available light emitting diode (LED) modules using less power so that the low cost integrated thin film EL technology utilized in the present invention is a viable alternative to standard LED configurations.

In other embodiments of the EL module constructed in accordance with the present invention, more than one row and column pattern could be patterned on one EL module and contact pads to each row and each column pattern could be fabricated. In still other embodiments, the display elements need not be arranged in a rectangular array but rather in a circle or any other desired manner to suit the application at hand. Each pixel can be of any shape, circular, rectangular or any other shape depending on the application at hand in accordance with the patterns chosen for layers 14, 16, 18, 20, 22 and layer 52 if present.

Layer 52 may be used to define complex pixel shapes such as letters, symbols, or even a pixel comprising a group of non-continuous light emitting elements. The conducting layers 14 and 18 may be continuous and the boundaries of the shape of light element or elements forming the pixel may be determined solely by the geometry of layer 52.

Therefore, while the electroluminescent display module has been described and illustrated with respect to the embodiments disclosed herein, it will be appreciated by those skilled in the art that numerous variations of these embodiments may be made without departing from the scope of the invention described herein.

Therefore what is claimed is:

1. An electroluminescent display module, comprising:

a) a light permeable substrate having a front, a back and side edges;

b) an array of display elements comprising a light permeable electrically conductive base coated on the back side of the light permeable substrate, a plurality of electroluminescent areas, and a counterelectrode coating at least part of each electroluminescent area, wherein one of the light permeable electrically conductive base and the counterelectrode is patterned to provide a plurality of electrically isolated sections each with an associated exposed contact pad, and the other of the conductive base and counterelectrode being a common electrode to at least some of the electroluminescent areas, each electroluminescent area being sandwiched between an electrically isolated section and said common electrode; and c) the contact pads being spaced inwardly from said substrate edges so that electrical contact to the array of display elements is made to the display module spaced away from the edges of the substrate.

2. The display module according to claim 1 wherein said array of display elements extends across substantially from edge-to-edge of said light permeable substrate.

3. The display module according to claim 2 wherein said display module is a first display module, and further including a plurality of display modules tiled together in edge-to-edge relationship to form an electroluminescent display panel.

4. The display module according to claim 3 wherein it is the light permeable electrically conductive base that comprises the plurality of electrically isolated sections each with an associated contact pad, the counterelectrode being common.

5. The display module according to claim 4 including a display element drive circuit means being mounted onto the back side of said substrate and electrically connected to the contact pads of the light permeable electrically conducting base and electrically connected to the counterelectrode.

6. The display module according to claim 5 wherein said display element dive circuit means includes a display element driver chip with a plurality of contact pins, each pin being attached to a contact pad of the light permeable electrically conducting base, and control signal means being attached to said counterelectrode.

7. The display module according to claim 3 wherein said display elements each include a first insulating dielectric layer interposed between the electroluminescent area and said light permeable electrically conductive base.

8. The display module according to claim 7 wherein said display elements include a second insulating dielectric layer interposed between the electroluminescent area and said counterelectrode.

9. The display module according to claim 8 wherein said first and second insulating dielectric layers envelop said electroluminescent layer.

10. The display module according to claim 8 including a protective moisture barrier for said array of display elements.

11. The display module according to claim 10 wherein said moisture barrier is a rigid barrier bonded to the substrate over said array of display elements having an array of apertures formed therein in registration with contact pads of the light permeable electrically conducting base and an exposed portion of the counterelectrode to which the control signal means is connected.

12. The display module according to claim 10 wherein said moisture barrier is a dielectric layer applied to the array of display elements and provided with apertures having an array of apertures formed therein in registration with exposed second portion of the light permeable electrically conducting base and an exposed portion of the counterelectrode layer to which the control signal means is connected.

13. The display module according to claim 4 wherein said electroluminescent display structure includes an insulating layer deposited onto said patterned light permeable electrically conductive base and the light permeable substrate and patterned so that it does not coat the contact pads of the light permeable electrically conductive base, the counterelectrode having a portion located above at least part of said insulating layer so that portions of said counterelectrode are located over portions of the light permeable electrically conducting base.

14. The display module according to claim 13 wherein said display elements include a first insulating dielectric layer interposed between the electroluminescent areas and said light permeable electrically conductive base.

15. The display module according to claim 14 wherein display elements include a second insulating dielectric layer interposed between the electroluminescent areas and said counterelectrode.

16. The display module according to claim 15 wherein said first and second insulating dielectric layers envelop said electroluminescent areas.

17. The display module according to claim 16 including an electrically insulating moisture barrier covering said array of display elements.

18. An electroluminescent display module, comprising:

a) a plurality of light permeable substrates having a front, back and side edges, said plurality of light permeable substrates being tiled together in edge-to-edge relationship to form an expandable display panel;

b) an array of spaced display elements being located on the back side of said light permeable substrates, each display element comprising a light permeable electrically conductive base portion coated on said light permeable substrate, a counterelectrode, wherein one of the light permeable electrically conductive base and the counterelectrode is patterned to provide a plurality of electrically isolated sections each with an associated exposed contact pad spaced inwardly from said side edges, and an electroluminescent material sandwiched between said conductive base portion and a portion of said counterelectrode; and c) each substrate provided with a display driver chip with a plurality of contact pins, said display driver chip being mounted on the back side of said light permeable substrate with each pin being electrically connected to a preselected number of display elements at positions spaced inwardly from said substrate edges, and control signal means being attached to said counterelectrode.

* * * * *